US011128941B1

(12) United States Patent
Blemel

(10) Patent No.: US 11,128,941 B1
(45) Date of Patent: Sep. 21, 2021

(54) METHOD FOR PASSIVE DISSIPATION OF DECONSTRUCTIVE HARMONICS DURING AUDIO AMPLIFICATION AND REPRODUCTION

(71) Applicant: Edward G. Blemel, Tijeras, NM (US)

(72) Inventor: Edward G. Blemel, Tijeras, NM (US)

( * ) Notice: Subject to any disclaimer, the term of this patent is extended or adjusted under 35 U.S.C. 154(b) by 0 days.

(21) Appl. No.: 16/689,902

(22) Filed: Nov. 20, 2019

Related U.S. Application Data

(60) Provisional application No. 62/769,742, filed on Nov. 20, 2018.

(51) Int. Cl.
*H04R 1/28* (2006.01)
*H04R 1/02* (2006.01)

(52) U.S. Cl.
CPC ..... *H04R 1/021* (2013.01); *H04R 1/2803* (2013.01); *H04R 1/2826* (2013.01); *H04R 2201/021* (2013.01)

(58) Field of Classification Search
CPC ..... H04R 1/22; H04R 1/28; H04R 1/2803; H04R 1/2807; H04R 1/2811; H04R 1/2888; H04R 1/2892; H04R 1/2896; H04R 1/34; H04R 1/345; H04R 1/347; H04R 1/021; H04R 1/2826; H04R 2201/021; H04R 1/2869; H04R 1/2873; H04R 1/2876; H04R 1/288; H04R 1/2884
See application file for complete search history.

(56) References Cited

U.S. PATENT DOCUMENTS

| | | | | | |
|---|---|---|---|---|---|
| 2,834,423 | A | | 5/1958 | Bradford | |
| 3,233,695 | A | | 2/1966 | Hutchins | |
| 3,768,589 | A | * | 10/1973 | Nilsson | H04R 1/288 381/336 |
| 3,987,144 | A | * | 10/1976 | Nickold | B29C 45/33 264/318 |
| 4,129,752 | A | * | 12/1978 | Griffin, Jr. | H04R 1/021 181/148 |
| 4,221,929 | A | * | 9/1980 | Fukuda | H04R 1/025 181/148 |
| 4,889,208 | A | | 12/1989 | Sugihara | |
| 5,170,436 | A | | 12/1992 | Powell | |

(Continued)

FOREIGN PATENT DOCUMENTS

| | | |
|---|---|---|
| CA | 2578697 A1 | 9/2006 |
| EP | 1 709 832 B1 | 10/2006 |

(Continued)

*Primary Examiner* — Kile O Blair
(74) *Attorney, Agent, or Firm* — Rod D. Baker

(57) ABSTRACT

A system, apparatus, and method for passive dissipation of deconstructive harmonics during audio amplification and reproduction. An apparatus including an advantageous form and type of speaker baffle/enclosure is provided to isolate and/or dissipate deconstructive harmonics in an electrical loudspeaker system. A system for passive dissipation of deconstructive harmonics during audio amplification or reproduction from an audio speaker (the speaker having a front face and a rear) includes an encapsulation and isolation body within which the audio speaker is placeable, a mounting means upon the isolation body exterior, and a resiliently flexible baffle connected to the mounting means and extending rearwardly from the speaker. The baffle optionally is vented.

19 Claims, 9 Drawing Sheets

(56) References Cited

U.S. PATENT DOCUMENTS

| | | | | |
|---|---|---|---|---|
| 6,367,579 | B1 * | 4/2002 | Wiener | H04R 1/021 181/156 |
| 8,422,714 | B2 | 4/2013 | Peng | |
| 8,479,874 | B2 | 7/2013 | Moreton Cesteros | |
| 9,288,561 | B1 | 3/2016 | Chu | |
| 9,674,602 | B2 | 6/2017 | Clark | |
| 2013/0043089 | A1 | 2/2013 | Rodgers | |
| 2018/0027321 | A1 | 1/2018 | Jaguste | |

FOREIGN PATENT DOCUMENTS

| | | | |
|---|---|---|---|
| GB | 793193 | B1 | 4/1958 |
| WO | 2005072005 | A1 | 8/2005 |

* cited by examiner

METHOD FOR PASSIVE DISSIPATION OF DECONSTRUCTIVE HARMONICS DURING AUDIO AMPLIFICATION AND REPRODUCTION

CROSS-REFERENCE TO RELATED APPLICATIONS

This application claims the benefit of U.S. Provisional Patent Application Ser. No. 62/769,742 entitled "Method for Passive Dissipation of Deconstructive Harmonics During Audio Amplification and Reproduction," filed on 20 Nov. 2018, the entire disclosure of which is hereby incorporated by reference.

BACKGROUND OF THE INVENTION

Field of the Invention

This invention relates to audio speaker apparatus, particularly to a system for improving the perceived sound emitted by a speaker, and specifically to a system for passively dissipating deconstructive harmonics during audio amplification and reproduction.

General Background

The current art of sound amplification and reproduction, in broad view, incorporates a sound source, for example; a microphone, recording or guitar pickup, and receiver amplifier coupled to speakers encased in Large Heavy Rigid Enclosures (LHRE).

The primary task of a speaker enclosure is to prevent deconstructive harmonics, generated by the back of the speaker, from interacting with the constructive harmonics generated by the face of the speaker. Because the harmonics generated by the rear of the speaker are out of phase with the harmonics generated by the speaker face, they will act to deconstruct, or cancel out, waves generated by the speaker face. Secondly, the enclosure creates a pocket of air which acts to smooth the movement of the speaker diaphragm as it works against it, this is industry termed baffling area or "baffle."

A speaker diaphragm includes a membrane that oscillates to generate the desired sound waves. If a baffle is not provided, the speaker membrane oscillations, especially those created during low frequency sound wave reproduction, go unchecked, allowing the speaker membrane to undulate uncontrollably, causing not only the distortion of the amplified sound wave, but ultimately leading to the destruction of the speaker membrane itself.

The most common type of enclosure is the finite baffle. This type of enclosure provides a finite amount of air trapped behind the speaker to act as the baffle. Large Heavy Rigid Enclosures, abbreviated LHRE in this disclosure, are utilized to create a pocket of trapped air of specific volume; this volume is calculated in accordance with the volume of air displaced by a specific speaker, based on data provided by the speaker's manufacturer.

Finite baffle enclosures can be designed and built airtight/sealed, or with vents. The sealed variety reputedly provides more accurate low frequency harmonic reproduction. While the vented version allows positive pressure pulses of deconstructive harmonics, to exit into the ambient space, creating a shockwave effect giving the illusion the low frequency harmonic is more powerful than it really is. However, the sound pressure waves released are comprised of deconstructive harmonics. Constructive harmonics produced by the speaker face will be canceled out by these deconstructive harmonics, so constructive harmonic reproduction accuracy is compromised inevitably.

The reason this undesirable deconstructive harmonic pressure wave is thought desirable, in this case, is because it masks the inherent inability of Rigid Materials to Isolate Sound Energy, which is explained in further detail later in this disclosure.

Because sound energy in air is waves moving at the speed of sound through the air molecules, LHREs are built of heavy, dense, rigid materials. Heavy dense rigid materials resist being distorted by the Sound Energy ricocheting repetitively inside the enclosure. LHRE are typically made from Medium Density Fiber Board, industry termed MDF Board, chosen for its innate ability to resist structural distortion, not for its inherent extreme weight. Reinforcements can be incorporated into the LHRE design to further combat structural distortion.

However, if the sound energy is capable of physically distorting the "sturdy" LHRE then, by proxy, it is capable (by the laws of physics) of distorting the "fragile" speaker membrane by the laws of physics. Air molecules, or the sound energy, trapped in the baffle seek out the path of least resistance in its efforts to escape confinement. In the case of the finite baffle design, that path of least resistance is the speaker diaphragm. The produced source signal is affected by the distorted speaker diaphragm; the finite baffle design actually increases undesirable distortion.

An alternative to a finite baffle design is the infinite baffle design, but this design too has inherent flaws that are hazardous to constructive harmonics. Infinite baffle design is commonly utilized where LHRE are problematic due to restricted available space, for example; in a boat hull or a car door, where the size of the enclosed area behind the speaker is not readily calculated, or infinite.

Speakers designed to operate with an infinite baffle design require specialized speaker membrane materials, which are resistant to cracking and tearing caused by unchecked speaker membrane undulations at low harmonic frequencies. These specialized materials can be cost prohibitive. Furthermore, since the speaker membrane oscillations are left unchecked, the accuracy of constructive harmonic reproduction is degraded from even that of a finite baffle design. The constructive harmonics produced by the diaphragm become distorted by the membrane itself, to an even greater extent than to which it occurs in a finite baffle design.

Basic Inherent Limitations of Building Materials

An important inherent limitation of all rigid matter is that it is impossible to isolate or restrain sound energy within a box or other confine composed of rigid matter. Because air cannot readily travel through solids, air molecules moving at the speed of sound inside a rigid, flat-walled confine (e.g., a speaker enclosure) ricochet off the interior walls of the enclosure and impinge upon the back of the speaker diaphragm. The speaker diaphragm is physically distorted by this sound energy. A distorted diaphragm produces a distorted sound wave. Furthermore, the out-of-phase sound energy acting on the rear reverberates through the diaphragm itself, canceling out many constructive harmonics before they reach a listener's ears. And because of the rigid matter used, LHREs are inherently heavy and unbendable; such speaker enclosures by default are heavy, cumbersome and occupy substantial volume. They also typically are rectangular, and so don't fit well in limited spaces.

Because the required size of the LHRE is calculated to accommodate the maximum air displacement capability of a given speaker, speaker membrane oscillations at lower power output levels are left largely unchecked, allowing the speaker membrane to undulate uncontrollably, creating at lower output levels distortion of the desired reproduced sound wave. Thus, when the baffle is sized for peak output, performance suffers at lower power output levels. Conversely, if the LHRE is sized for lower power outputs levels, performance suffers at higher output levels.

Roll on, Roll Off and their Associated Narrow "Sweet Spot" Syndrome

The industry term "roll-on" refers to the point at which the speaker's air displacement volume is no longer in deficit to that of the baffle volume. Air pressure is now adequate within the baffle volume to buffer the speaker diaphragm movement. Distortion created within the speaker membrane subsides—in other words "rolling the power on" until speaker diaphragm distortion subsides. The term "roll off" refers to the point when the speaker's air displacement volume creates excessive pressures within the baffle volume. The excessive pressure begins to forestall speaker membrane oscillations. This is the point at which one needs to "roll off" the power until the negative effect upon membrane oscillation subsides.

The expression "sweet spot" refers to the point at which the air pressures within the baffle volume is perceived to be "perfect" for buffering speaker membrane oscillations. Prior art publications by Stuart Michael Neville, Hubert Krass, R. L. Bradford, Sugihara Katsutoshi, R. E. Hutchin, Andrew Clark, and Walter Chu all propose add-ons or modifications to the LHRE itself to overcome the LHRE's undesirable aspects of roll on, roll off, and their associated "narrow sweet spot syndrome".

A purpose of the disclosed invention is to eliminate the need for LHREs and to eliminate the syndromes of roll on, roll off and narrow sweet spot. It is further an object of the invention to provide a method for isolation of deconstructive harmonics from constructive harmonics. The invention also intends to provide a method for passive dissipation of deconstructive harmonics during audio amplification and reproduction.

SUMMARY OF THE DISCLOSURE

There is disclosed a system, apparatus, and method for passive dissipation of deconstructive harmonics during audio amplification and reproduction. An apparatus including an advantageous form and type of speaker baffle/enclosure is provided to isolate and/or dissipate deconstructive harmonics in an electrical loudspeaker system.

A system for passive dissipation of deconstructive harmonics during audio amplification or reproduction from an audio speaker (the speaker having a front face and a rear) includes an encapsulation and isolation body within which the audio speaker is placeable, a mounting means upon the isolation body exterior, and a resiliently flexible baffle connected to the mounting means and extending rearwardly from the speaker. The isolation body defines either a circular or a rectilinear ring. The isolation body preferably is an annulus, and the speaker is disposed within the central opening of the annulus. In a preferred embodiment, the isolation body is composed of an elastically resilient, bendable, material.

In the system, the mounting means normally comprises a mounting flange. The mounting flange may be a unitary annular ring, and typically is composed of an elastically resilient, bendable, material. Alternatively, the mounting flange may be a plurality of separate arcuate flange segments arrangeable to define an annular ring; in such case the arcuate flange segments comprise a rigid material.

In the system, the baffle preferably is injection molded from an elastically flexible polymer. The flexible baffle preferably, but not necessarily, defines a tube having a proximate end sealably secured to the mounting means, as well as a distal end. The baffle also may be fabricated from a sheet of elastic, air resistive material rolled to define a tubular topology, and with two edges of the sheet in mutual contact and sealed together. The proximate end of the baffle is sealably secured to the mounting means or flange. The baffle may be vented in any of several ways, including vents that a controllable to regulate the amount of venting from the baffle interior.

Significantly, the system allows for the elimination/exclusion of large, heavy, rigid speaker enclosures. So, in a system according to the present disclosure, for passive dissipation of deconstructive harmonics during audio amplification or reproduction from an audio speaker (the speaker having a front face and a rear), the system can consist essentially of: (1) an encapsulation and isolation body within which the audio speaker is placeable; (2) a mounting means upon the isolation body exterior; and (3) a resiliently flexible baffle connected to the mounting means and extending rearwardly from the speaker; wherein the system excludes the use of a large heavy rigid enclosure near the rear of the speaker

BRIEF DESCRIPTION OF THE DRAWINGS

The attached drawings, which form part of this disclosure, are as follows.

Figure 1:
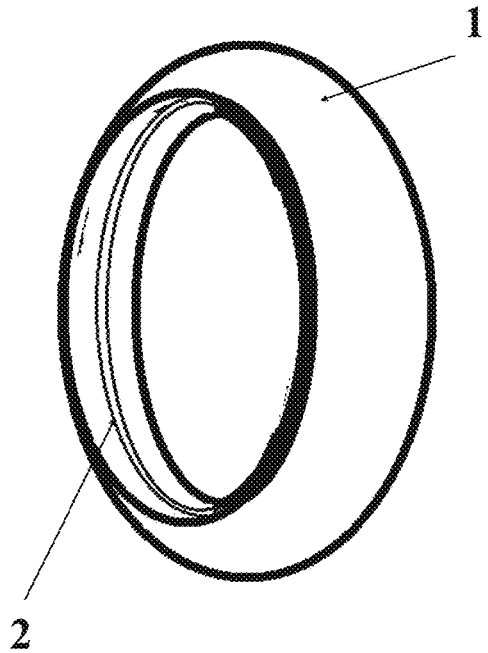
FIG. 1 is a front perspective view of an encapsulation and isolation body usable in a system according to the present invention.

The drawings are not necessarily to scale, either within a view or between views.

DESCRIPTION OF A PREFERRED EMBODIMENT

There is provided hereby a system and method for passive dissipation of deconstructive harmonics during audio amplification and reproduction. An apparatus including an advantageous form and type of speaker baffle/enclosure is provided to isolate and/or dissipate deconstructive harmonics in an electrical loudspeaker system.

It has been concluded that Large Heavy Rigid Enclosures (LHREs) are actually detrimental to the accurate reproduction of an amplified signal from any source. Further, any speaker enclosure made of any rigid matter is detrimental to the accurate reproduction of any source signal. Before creating a speaker enclosure, one first needs to consider the speaker itself. This aides in discovering if an enclosure is required, and why it is desired other than just for protection from its surroundings. In evaluating a speaker, it is evident that the surface area of the speaker face is significantly less than the surface area of the complete assembly that is the speaker chassis and magnet. A greater surface area contacts a greater number of air molecules, which in turn means a greater number of molecules vibrated by the greater surface area. The back of the speaker thus has a greater ability to reverberate sound energy than does the speaker face.

It is known in the art that the back of a speaker emits harmonics that are out of phase with the harmonics emitted from the speaker face. These out-of-phase harmonics are termed "deconstructive" harmonics. Because the rear or back of the speaker has a greater surface area, it exhibits a greater ability to produce harmonics then does the comparatively lesser surface area of face of the speaker. It accordingly is desirable to isolate the speaker back from the speaker face.

In seeking to determine a method for isolating harmonics, we must first ascertain the physical facts of sound energy and use these facts, collectively, to formulate a test to utilize in determining each proposed materials energy isolation potential, before creating a method for isolation.

Recalling that the speaker chassis reverberates deconstructive harmonics, it is helpful to note Isaac Newton's First and Second Laws of Physical Mechanics. These two laws together indicate that any mass directly coupled to another mass will oscillate and/or reverberate, in accordance with each other's ability to do so, in concert with each other. This means that unless one mass exhibits widely disparate energy dissipation properties compared to the other, the two will vibrate as one. So, any additional rigid matter coupled to a rigid speaker chassis assembly, in effect, creates an even larger area that reverberates deconstructive harmonics.

Accordingly, Newton's Laws, taken alone, discourage solid matter as a candidate for an isolation material. Rigid matter, by Newtonian physical laws, creates a greater surface area reverberating deconstructive harmonics when coupled to the rigid chassis matter of the speaker. Albert Einstein's theories on relativity have, scientifically, proven to be accurate. Sound is generally subject to Einstein's theories, including the theorem that E=MC, which states (in simple terms) that energy and matter are equal and transmutable. Therefore, Newtonian laws and Einstein's theorems may be applied collectively to analyze rigid matter as an isolation candidate in speaker harmonics.

Sound is energy, and reverberates through air molecules. Sound energy reverberates through solid matter, liquids and gases. Solid matter is, again, eliminated as an isolation prospect from the onset. The aforementioned teachings can also be utilized to extrapolate a more complete view of the full extent of the hazard created to accurate constructive harmonic reproduction through amplification when utilizing solid matter as an isolation material. When rigid, solid matter is used as an isolation material, it creates an expanded surface area, which exhibits a greater potential to resonate deconstructive harmonics. The deconstructive harmonics are not isolated at all. Furthermore, the solid matter is also reverberating with a cacophony sound wave energy that is ricocheting inside of the confining structure for the speaker. This mass is reverberating, at the rear of the speaker, deconstructive harmonics in essentially the same physical space as the constructive harmonics emitted from the face of the speaker—with the result that constructive harmonics are deconstructed or cancelled out.

In view of this, we again revisit Einstein's theory of relativity, which implies in the present context that any rigid matter, gas or liquid in proximity to the LHRE's structure will reverberate with the sound energy emitted by the LHRE's mass by proxy. To clarify, when a LHRE is placed in front of a wall, the wall will not only reverberate with the deconstructive harmonics emitting from the mass of the LHRE, but also redirect the air molecules, transmitting the deconstructive sound energy, as a passively radiating speaker, in the same manner as the LHRE, the redirected sound energy in turn affects all other rigid matter, gas or liquids within the ambient space (such a room in which a speaker is located) in the same manner.

When rigid solid matter is chosen as an isolation material, it will not isolate the sound energy. Instead, it creates a greater surface area from which the deconstructive sound energy is emitted. This deconstructive energy affects all matter in the ambient space (the room in which the speaker is being used). As a result, the entire room is filled with deconstructive harmonic waves. The listener hears only constructive harmonics generated by the face of the speaker that are not actively deconstructed. Furthermore, the only reason the listener can perceive the sound energy emitted by the face is because the sound waves are physically thrust forward by the speaker membrane's aforementioned air-pumping attributes. Therefore, the intended listener hears the sound energy emitted by the speaker face only if they are directly or nearly directly in confronting relation to the speaker face. Furthermore, the sound wave energy that reaches the listener will have been deconstructed by the ambient distortion discussed immediately above. The listener likely perceives more deconstructive harmonics reverberating through the rigid enclosure than constructive harmonics being emitted by the speaker face itself.

It is now possible to explain why an undesirable deconstructive harmonic pressure wave is thought to be desirable in the case of the LHRE or any rigid enclosure.

High frequency harmonics have greater harmonic canceling potential than low frequency harmonics. (There are a greater number of oscillations between nodes in a high frequency harmonic, which thus crossover more often the lower frequency wave.) Thus, low frequency harmonics often are the first to be cancelled. The surviving harmonics that emanate from a rigid enclosure's walls are comprised mostly of high frequency harmonics. Ostensibly only the deconstructed remains of low frequency harmonics that have not been "deconstructed" by the high frequency harmonics pass through the rigid enclosure's walls, to entering the surrounding ambient space. The listener thus hears an attenuated version of the harmonics generated by the speaker back, instead of the full spectrum of harmonics.

The pressure wave generated during low frequency waves production is, however, more powerful than that of high frequency harmonics, owing to greater speaker membrane travel. Venting the LHRE allows the low frequency spectrum of harmonics to exit the enclosure under pressure. This sound pressure wave pushes the full spectrum of harmonics on its wake. The result is that listener now can hear the full spectrum of harmonics emanating from the speaker back. Ostensibly, the listener receives only the high frequency deconstructive harmonics reverberated through the LHRE's rigid matter, not the low frequency harmonics, until the LHRE is vented. When the LHRE is vented, a listener who is not directly facing the front of the speaker perceives the full spectrum of deconstructive harmonics produced by the speaker's back. This creates, in theory, the illusion of a fuller spectrum or more powerful sound within the ambient listening space, because the indirect listener perceives an incomplete set of the deconstructive harmonics until the LHRE was vented.

However, what in fact happens is the deconstructive harmonics "riding" on the high pressure wave have entered the ambient space ahead of the deconstructive harmonics reverberating through the case in "relative spacetime". This effect is created because "relative speed" of the deconstructive harmonics (reverberating through the LHRE's rigid matter) has been reduced, while the "relative speed" of the deconstructive harmonic high pressure wave has been accelerated because air pressure waves venting through a restrictive orifice accelerate as they exit the restrictive orifice. This phenomenon is known as the Venturi Principle.

It is current state of the art to utilize various techniques to forestall in time the low frequency deconstructive harmonic pressure waves in time, so they exit the vent at approximately the same moment at which their counterpart high frequency deconstructive harmonics reach the outer faces of the LHRE's rigid matter. Tubes of tuned length, diameter and layout and/or chambers and passageways are common example of this state of the art. Low frequency deconstructive pressure wave time delay techniques serve to realign deconstructive harmonic frequencies in spacetime, so that the listener now hears the full spectrum of deconstructive harmonics, produced by the rear of the speaker, dominating the ambient space, deconstructing any remaining constructive harmonic waves in their wake. The listener cannot now discern a speaker's physical location unless it faces the user directly.

The proliferation of deconstructive sound waves, as discussed, is a leading suspect in explaining the phenomena of misquoted lyrics. It is common knowledge that if a person does not perceive all the words in a phrase clearly, the person's mind chooses, from memory, sequentially logical assumed words to complete the phrase. Daily, we assume many words from the context of the phrasing, especially in loud environments. For example, in a loud office you might think you heard your cohort say, "Let's go get some coffee," when she actually said, "Why don't we go get some coffee?" This phenomenon is also evident when listening to audio books and is evident when utilizing programs designed to teach foreign languages from an amplified source. We replace distorted words with logical, probable, sequential assumed words, unless we have insufficient words memorized; then the only option is to rewind the source repeatedly, adjusting equalizer band widths in the hope of clarification. This phenomenon is problematic when attempting to learn new languages. Distorted sound perception leads to distorted memorization. Therefore, an object of the invention is to prevent the mass proliferation of deconstructive sound waves.

Because matter is required to create a sound isolation means, it is desirable to employ matter that, during transmutation, dissipates energy. A material with qualities like that of the fabric of spacetime (first conceptualized by Hermann Minkowski as a way to reformulate Albert Einstein's special theory of relativity, to create a theoretical "spacetime pocket") ideally would serve to isolate the sound energy in space and time during transmutation. Owing to the desire to eliminate the conditions of roll-on and roll-off as discussed hereinabove, the desired material must also exhibit the ability to trap air molecules as well as demonstrating expansive and contractive qualities. This disclosure accordingly is of a system and apparatus for isolation of the entire speaker chassis assembly from all forms of matter capable of reverberating deconstructive harmonics. There is disclosed the utilization of flexible stretchable materials in constructing a means for isolation and dissipation of deconstructive sound wave energy, as these materials exhibit all the desired attributes required for both isolation and dissipation.

A wide variety of flexible, stretchable, yet air-restrictive materials suitable for use in the present apparatus and method are available commercially. Of these, rubberized materials are the least expensive. However, many rubberized materials exhibit undesirable flame propagation properties. As speakers utilize electrical energy to generate sound energy, electrical speakers are accompanied by the risk of electrical arcing, which can ignite flammable materials. There is disclosed herein the use of materials, in a baffle component, which mimic the properties of rubber, but with the exceptions that they resist flame propagation and exhibit greater resistance to environmental hazards. For example, neoprene, and specifically silicon compounds, desirably exhibit these desired traits.

The system and apparatus may be made in a variety of standard configurations, or custom configurations allowing them to be adaptively sized and shaped to fit a particular speaker and/or a limiting spatial requirement or specification. Moreover, in this system and apparatus the speaker mounting flange does not contact with any matter capable of reverberating sound energy directly.

Summarily characterized, the system and apparatus are useable in combination with, and are applied to, a conventional audio loudspeaker. The system and apparatus include an encapsulation body means which includes at least a mounting flange for the speaker chassis. Attached to the mounting flange is a passive expandable baffle. The baffle is a three-dimensional component fabricated from a flexible and elastically resilient material, such as (but not necessarily) a sheet of material, which may be any of various polymers. A polymer sheet may be rolled, bent, plaited, and/or folded into any of countless suitable baffle shapes, and may have two or more of its edges welded together, or otherwise secured together, to maintain its overall desired shape. With the present system and apparatus, no large, heavy, rigid speaker enclosure is used or desired.

Figure 2:
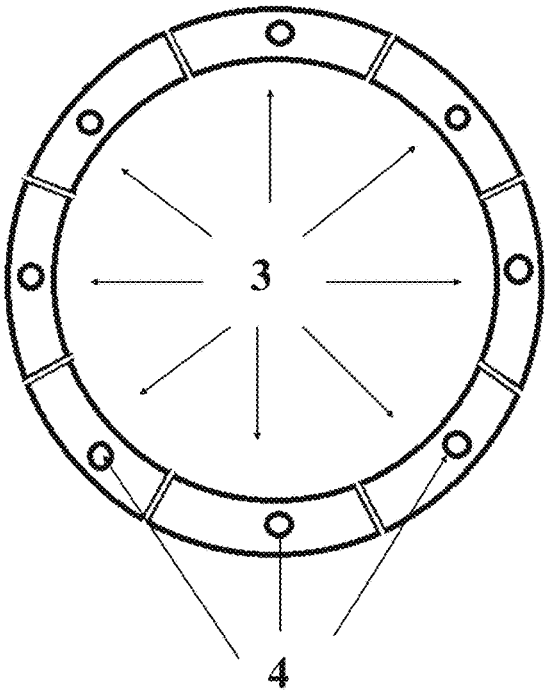
FIG. 2 is a front view of a mounting flange usable in a system according to the present invention.
Figure 3:
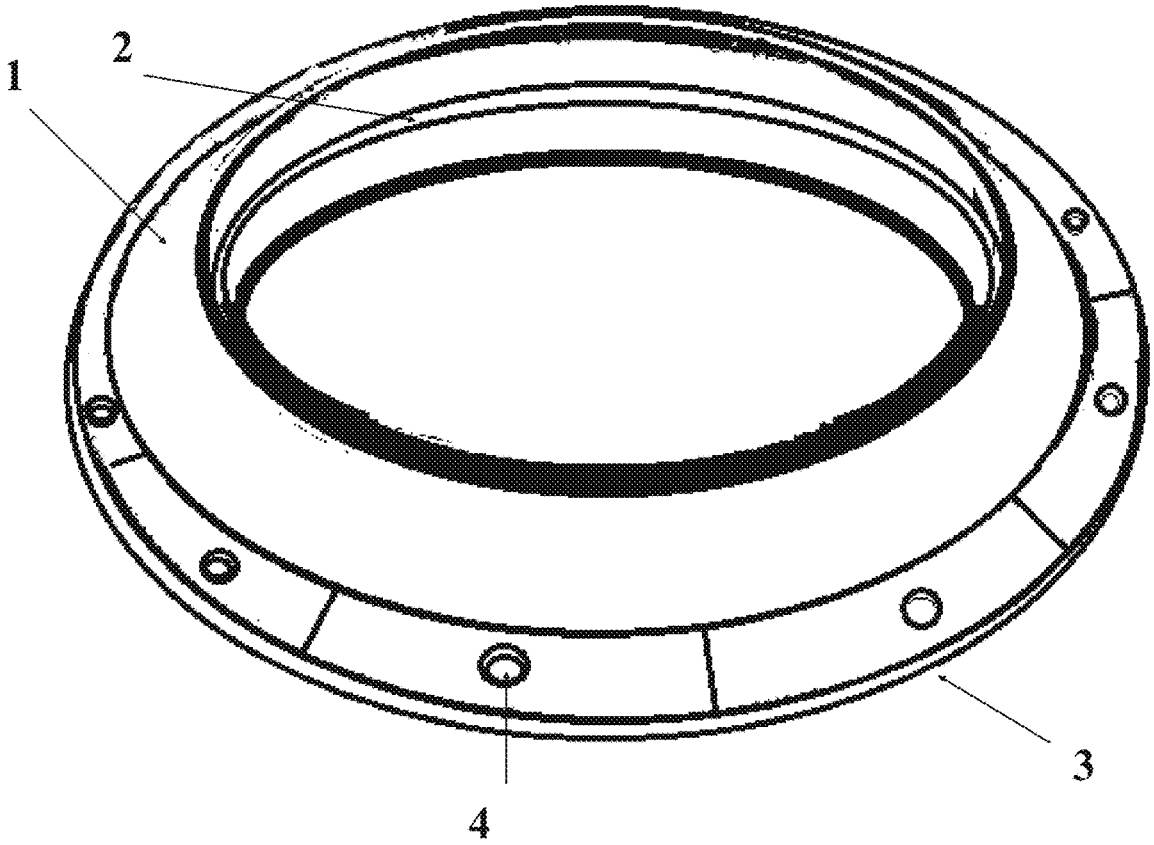
FIG. 3 is a perspective view of an encapsulation and isolation body joined with a mounting flange, the combination being usable in a system according to the present invention.

Reference is invited first to FIGS. 1-3, which illustrate components of a speaker chassis encapsulation and isolation system according to the present invention. Principal elements of the system are the encapsulation and isolation body 1, the mounting flange 3, and the baffle 5. The encapsulation and isolation body 1 is joined to a speaker chassis' mounting flange 3. As seen in FIG. 1, the speaker chassis encapsulation and isolation body 1 in a preferred embodiment is an annulus, and defines in its inner circumference a receiver groove 2. The receiver groove 2 receives and secures therein the outer periphery of a selected speaker. Typical suitable speakers 13 are shown in FIGS. 13, 14, 15, 16, 17 and 20 as engaged with the received groove 2 and secured within the encapsulation and isolation body 1. Also used with the encapsulation and isolation body 1 is a (optionally segmented into arc sections) mounting flange 3. The isolation body 1 and the speaker chassis mounting flange 3 may be fabricated using known injection molding techniques, and thus may be composed of polymer material(s). Liquid rubberized material is injected into custom fabricated injection molds and allowed to cure, for example in the manner rubberized O-rings and grommets are currently manufactured. After its molding, the annular isolation body 1 preferably is elastically flexible, so to be modestly stretchable and bendable, yet tending to rebound to its initially molded size and contours. The physical dimensions and configuration of the encapsulation and isolation body 1 accordingly can be resiliently bendably altered to tailor its shape and its isolation and dissipation abilities to match a specified speaker's requirements.

In the figures, the isolation body 1 and the mounting flange 3 are shown defining generally circular peripheral contours, each thus comprising an annular topology. This is due to the fact that most speakers also are round, with the diaphragm defining a disk shape and the speaker chassis likewise incorporating a circular shape. However, square and rectangular speakers are known in the art. The drawing figures thus are not to be construed as limiting, because the isolation body 1 and the mounting flange 3 may be shaped to define squares or circles, for receiving and accommodating a speaker of the corresponding shape, where the isolation body and the flange each defines a circular or rectilinear ring. Nevertheless, in most applications the isolation body 1 and the mounting flange 3 define complementary annular configurations, as seen in the drawing figures.

The mounting flange 3 is reliably attached to the outer periphery of the encapsulation and isolation body 1 in use, as seen in FIG. 3. In the preferred embodiment, the encapsulation and isolation body 1 is bonded, preferably during the molding process, to be integrated concentrically within its mounting flange 3, configured as seen in FIG. 3.

Figure 4:
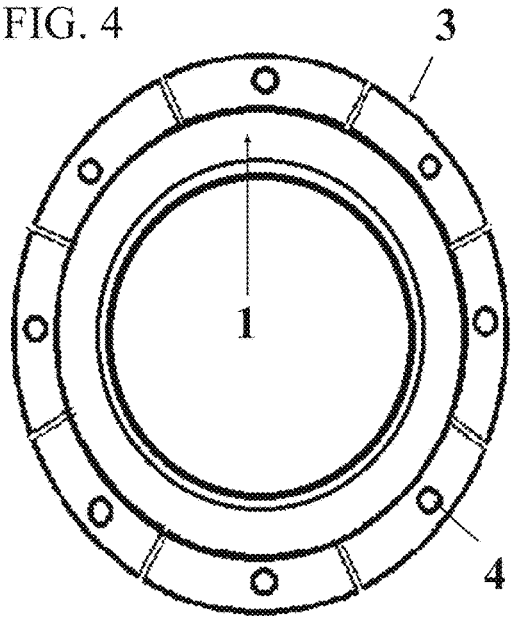
FIG. 4 is a front view of a version of a mounting flange according the present invention, showing that the flange may be composed of a plurality arcuate flange segments, and each segment is separated from adjacent segments by a uniform first distance.
Figure 5:
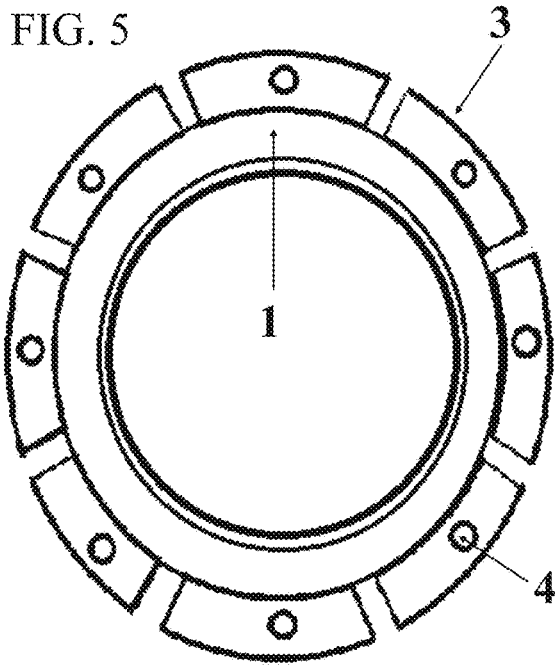
FIG. 5 is a front view of a mounting flange, similar to the flange seen in FIG. 4, showing that the flange may be composed of a plurality arcuate flange segments, and each segment is separated from adjacent segments by a uniform second distance.
Figure 6:
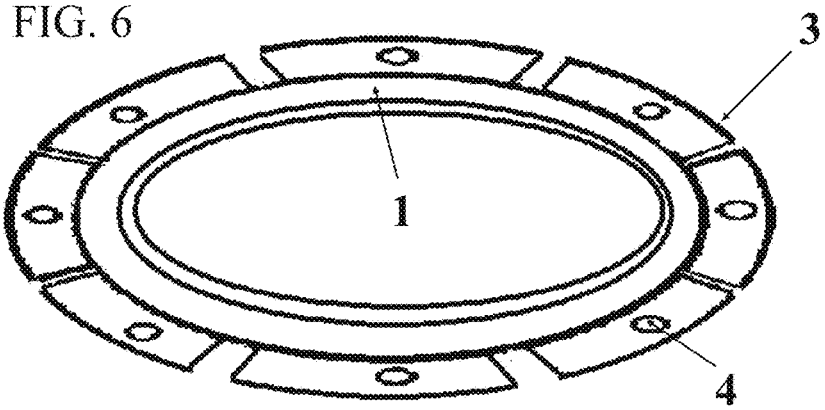
FIG. 6 is a perspective view of the mounting flange seen in FIG. 5, also showing that the flange is penetrated by at least two mounting holes or apertures.

FIGS. 4-6 offer views of a mounting flange 3. As depicted, the mounting flange 3 preferably but to necessarily is constituted from a plurality (e.g., two to ten, preferably eight) arcuate flanges segments. The flange 3 in use is for mounting the encapsulation and isolation body 1 to the other elements of the complete system and apparatus. The mounting flange 3 (whether segmented or not), is provided with at least two, preferably more, mounting holes 4 defined therethrough, as seen in FIGS. 2-6. Screws (not shown) or other similar fasteners are passed through the holes 4 to connect the flange 4 to other system components. The flange 3 may is elastically flexible, or if segmented may be composed from rigid plastics or metals. If segmented, each segment of the flange 3 has at least one mounting hole 4. The speaker chassis mounting flange encapsulation and isolation body 1 is stretchably expandable, allowing it to be elastically deformed to fit various shapes and circumferences within a selected given range. A small range of body 1 diameters may be produced to fit a variety of speaker shapes/sizes, whether they are of round, oval or other configurations. As suggested by FIGS. 4 and 5, the effective diameter and circumference of a flange 4 can be adjusted in a given application, by uniformly spacing the flange segments a selected distance, larger or smaller, to match the circumference of the other component to which it is attached. Also, the preferred segmented flange 3 can expand and contract as an integrated unit with the encapsulation and isolation body 1. Notably, the overall system and apparatus is not of finite or infinite baffle design; rather, it has an "expansive baffle" design.

It is seen, therefore, that in the present system the mounting flange 3 may be a unitary annular ring (e.g., per FIG. 3) of elastically resilient, bendable, material. Alternatively, according to desired usage, the mounting flange 3 may be a plurality of arcuate flange segments arrangeable to define an annulus, as suggested in FIGS. 5 and 6.

Figure 7:
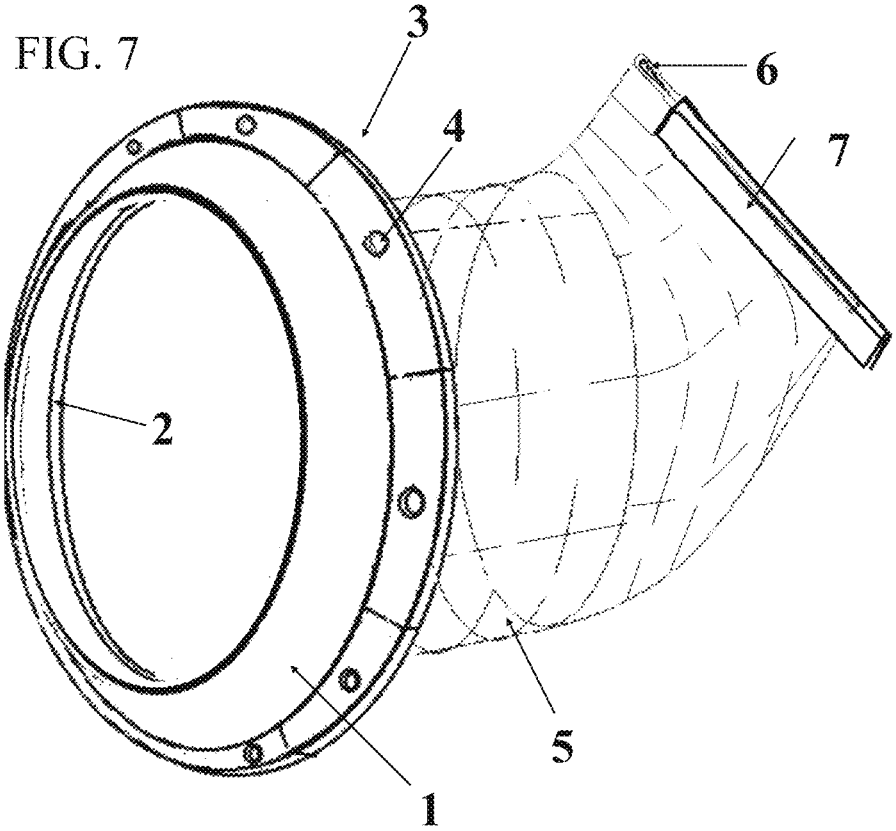
FIG. 7 is a front perspective view of a system according to the present invention, showing a mounting flange joined to an encapsulation and isolation body, and with a baffle attached to the rear of the mounting flange, and also showing an adjustable vent mechanism on the baffle.
Figure 8:
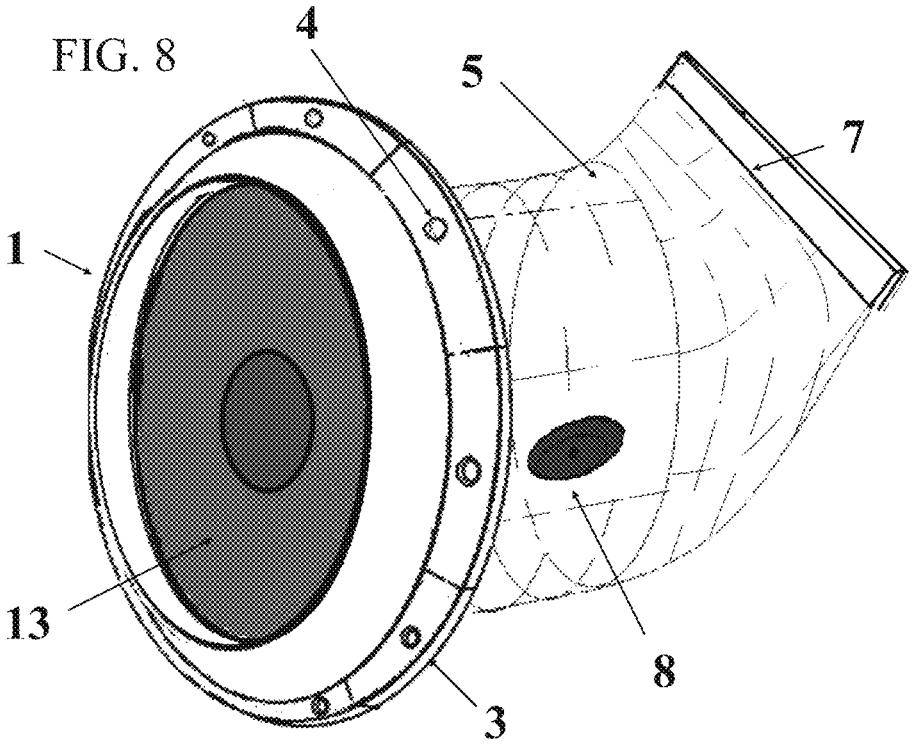
FIG. 8 is a front perspective view, similar to the view of FIG. 7, showing a system according to the present invention with a speaker disposed within the encapsulation and isolation body, and also showing a sphincter valve vent in the wall of the baffle.

The complete system and apparatus accordingly include an elastically expanding/contracting baffle. FIG. 7 shows a possible embodiment of the system and apparatus according to the present disclosure, including a passive expandable baffle 5 secured to the back side of the speaker chassis mounting flange 4. FIG. 8 is similar to FIG. 7, but also shows a speaker 13 disposed within the isolation body 1 of the complete system assembly. The isolation body 1 defines an annulus, and the speaker 13 is disposed concentrically within the central opening of the annulus. The speaker 13 projects its constructive harmonics from the front of the system, i.e., toward the left in FIGS. 7 and 8. The speaker chassis is disposed on the isolation body, e.g., by engagement with the groove 2 in the body 1 (FIGS. 1 and 3); the speaker diaphragm at rest is, in an example system configuration, approximately (but not necessarily) coplanar with the plane defined by the flange 4.

The baffle 5 functions instead of the rear speaker enclosure of a conventional loudspeaker assembly. The baffle 5 is not rigid, but rather is bendably flexible, and thus is an antithesis of a conventional LHRE. The baffle 5 may be of any size adapted for use with size of speaker 13. The baffle 5 encloses within an interior volume for receiving sound energy (waves in air molecules) emitted from the rear of the speaker 13. The interior volume of the baffle is expandable and contractable in direct correlation and proportion to the interior air pressure. The static interior volume (when the baffle is at rest) is selected, according to principles known in the art, to match the acoustic characteristics and performance of the speaker 13 to which the present system is to be attached. The sound energy entering the baffle interior is mostly contained, except as controllably vented as described further herein.

Referring to FIG. 7, the system and apparatus feature the passive, expandable, baffle 5. This baffle element 5 is formed of a thin and floppy material composed from a flexible, elastic, air-resistive (or air-impermeable) material, such as rubber, as discussed previously. Rubber is, technically, a pliable material derived from the sap of the rubber tree, but a hydrocarbon polymer of isoprene, or other synthetic resiliently pliable polymers, may serve in the composition of the baffle 5. The baffle 5 preferably is manufactured to a preselected shape and size by means of injection molding, as known in the art of polymer products fabrication. Alternatively, the baffle 5 may be fabricated from a sheet of pliable material that is "rolled" or otherwise manipulated, and/or possibly cut/stamped (e.g., with a pattern and cutting press), to define a generally tubular topology, with two edges of the sheet brought into registration contact and sealed together as by welding or with a permanent adhesive. It is to be understood, however, that such a sheet may be cut, and rolled, folded, or otherwise configured into any a nearly an infinite number of shapes.

The expansive baffle 5 is adapted to enclose and substantially or mostly surround all matter and surface at the back of the speaker 13. The baffle 5 usually is generally tubular in overall shape, and has a terminal edge at one end sealably connected to the back side of the mounting flange 3. The elastic baffle 5 serves as the means to isolate and dissipate deconstructive harmonics produced by, and transmitted backward from, the rear of the speaker 13. The expansive baffle 5 may be manufactured by known injection molding or extrusion forming techniques, similar to the manner tire inner tubes are made. The physical thickness of an expansive baffle 5 material can be finitely modified to tailor its isolation and dissipation abilities to match any accompanying speaker's specific requirements.

Figure 11:
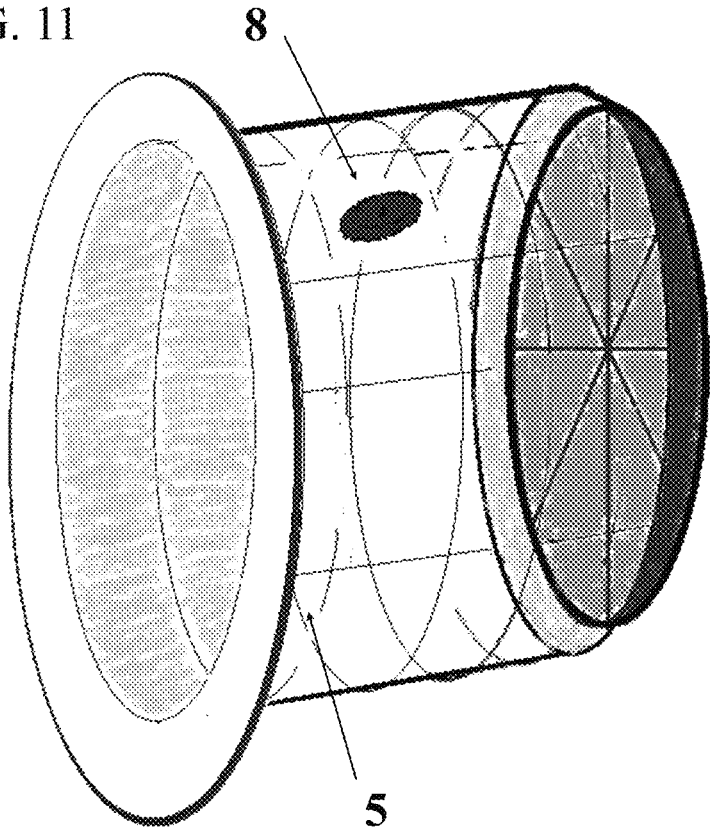
FIG. 11 is a perspective view of another embodiment of a system according to the present invention, showing an integrally molded isolation body and mounting flange, and depicting the disposition of the sphincter valve vent of FIG. 8 in the wall of the baffle.
Figure 12:
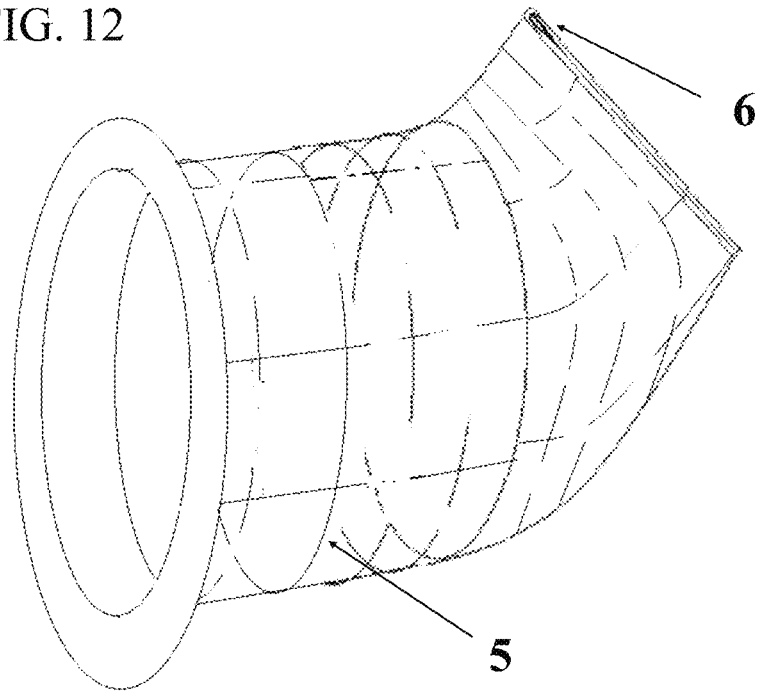
FIG. 12 is a perspective view of another embodiment of a system according to the present, similar to that of FIG. 11, showing an integrally molded isolation body and mounting flange, and depicting a baffle with a closed distal end.
Figure 13:
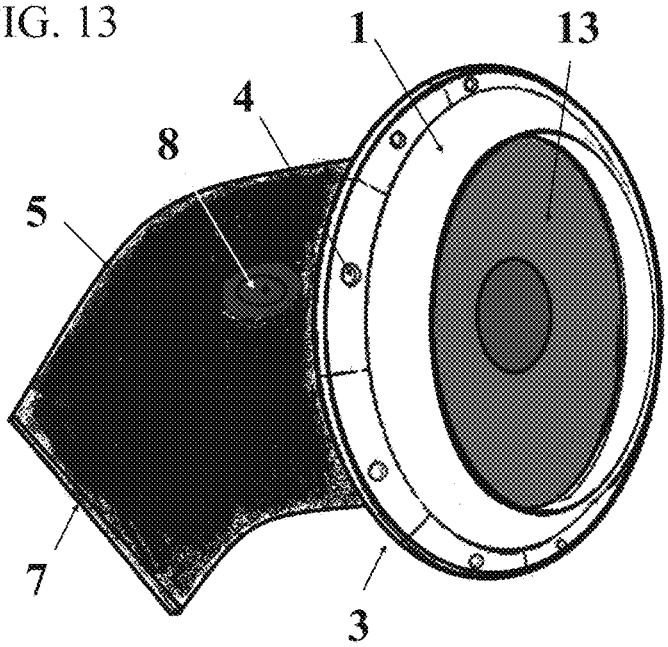
FIGS. 13-15 are perspective views of various alternative embodiments of a system according to the present invention, illustrating exemplary alternative baffle shapes and configurations.
Figure 14:
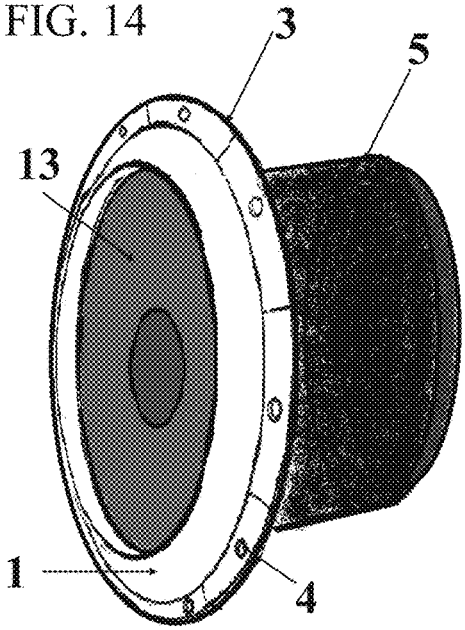
Figure 15:
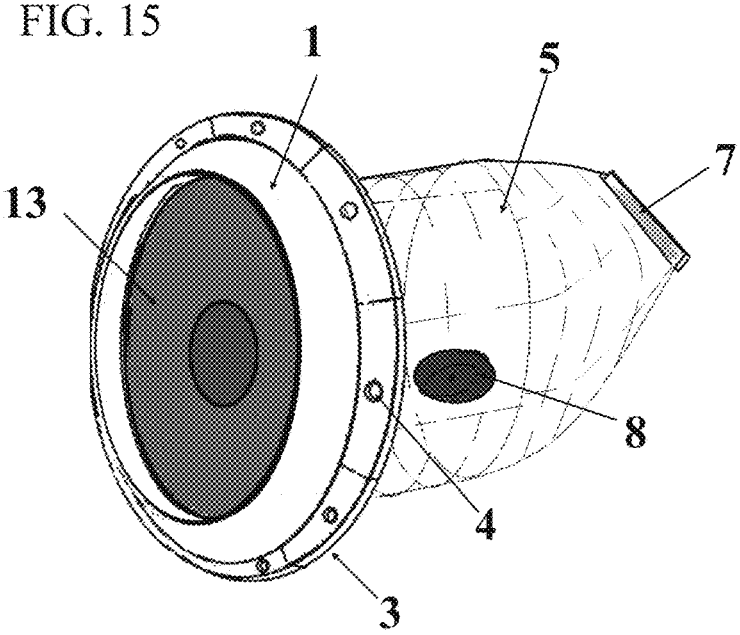

The expansive baffle 5 may be fastened to and in contiguous contact with the speaker chassis mounting flange encapsulation and isolation assembly (1, 3) as depicted in FIG. 7, or it may be molded with the assembly as an integrated modular unit as suggested by FIGS. 11 and 12. The expansive baffle 5 may be constructed in any of a wide variety of differing configurations. While often formatted as a generally cylindrical tube, as suggested by FIGS. 7 and 8, the baffle 5 can be created in other shapes, and in sizes/diameters corresponding to typical speakers with which the baffle is to be combined. By way of nonlimiting example, a baffle 5 can be fabricated in shapes resembling a boot, a frustoconical tube, a bowl, or an application-specific shape. FIG. 13 shows a somewhat "boot" or elbow-shaped baffle 5. Or the baffle 5 can be more frustoconical in shape, ordinarily with the larger base attached to the mounting flange, as suggested by FIG. 14. Moreover, the baffle's distal end can be sealed closed and unvented, as suggested in FIG. 15. Or, in the case of a tubular or nearly any other configuration, an end (i.e., the distal end of the baffle opposite the attachment to the speaker mounting flange 3) may be decidedly open as seen in FIGS. 11 and 14. It also is understood that because the baffle 5 is fabricated from a elastically pliable material, the baffle can be manipulated by bending and/or folding the baffle material to conform its overall configuration to a desired shape, such as to dispose it into a confined or unusually shaped space (such as in a car door). Manipulating the overall configuration of the baffle 5 also may be selectively employed to adjust the effective volume of its interior.

The expansive baffle 5 may incorporate either of two types of passive expanding vents for regulating baffle internal air pressure (to prevent brief pressure spikes from acting against the rear of the speaker), and to moderate speaker temperature. FIG. 6 shows the baffle 5 with the distal end mostly sealed, but with a small vent opening 6 to permit some pressure release from the baffle interior. Combined reference to FIGS. 7 and 8 shows that one type of vent 6 is defined at the distal end of a tubular baffle 5. There is provided at, and upon, the distal end of the baffle a slidable clip 7, as seen in more detail in FIG. 10. The clip holds closed the otherwise open distal end of the baffle 5. The clip 7 has a length at least equal to the diameter of the baffle tube. The clip can be slipped, shifted, or otherwise moved to a position that completely closes the distal end of the baffle tube, as seen in FIG. 8. When desired or indicated, the clip 7 is moved along the end of the baffle tube so to selectively open partially the distal end, as shown in FIG. 7 and best seen in FIG. 10. With the clip 7 moved to place the distal end of the baffle 5 in such partially open condition, the baffle is vented from its interior volume to the exterior. A use can place the clip 7 in any selected position so to close, nearly close, partially open, or nearly fully open the distal end of the baffle 5 as may be indicted or desired.

Figure 10:
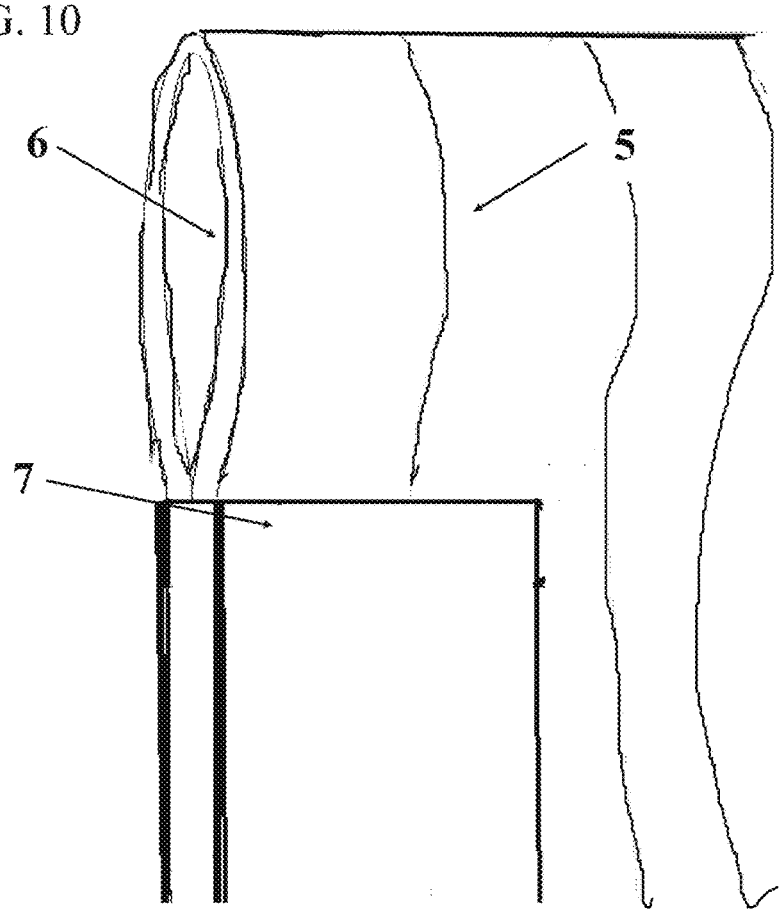
FIG. 10 is an enlarged perspective view of an adjustable vent mechanism, as seen in FIG. 7 (vent partially open) and in FIG. 8 (vent closed), useable in a baffle in a system according to the present invention.

Accordingly, the system and apparatus alternatively may include the passive adjustable vent 6 shown in FIG. 7, and in a close-up view in FIG. 10. The adjustable closure means 7 seen in FIGS. 7, 8, and 10, is configured to partially close the distal end of the tube style embodiment of the apparatus shown in FIG. 7, or completely close it, as shown in FIG. 8. The closure means 7 may be a sliding or clipping assembly, seen in the partially open condition in FIG. 7 and closed condition in FIG. 8. Adjustable closure 7 may be composed from rigid materials that exhibit a spring force clamping action, similar to the form and function of known molded plastic paper binder spine retainers. This adjustable vent 6 provides a tunable feature, as it passively expands and contracts in correlation with internal air pressures. Deconstructive harmonics are dissipated within the expansive baffling area 5 prior to air expulsion into the ambient space.

Figure 9:
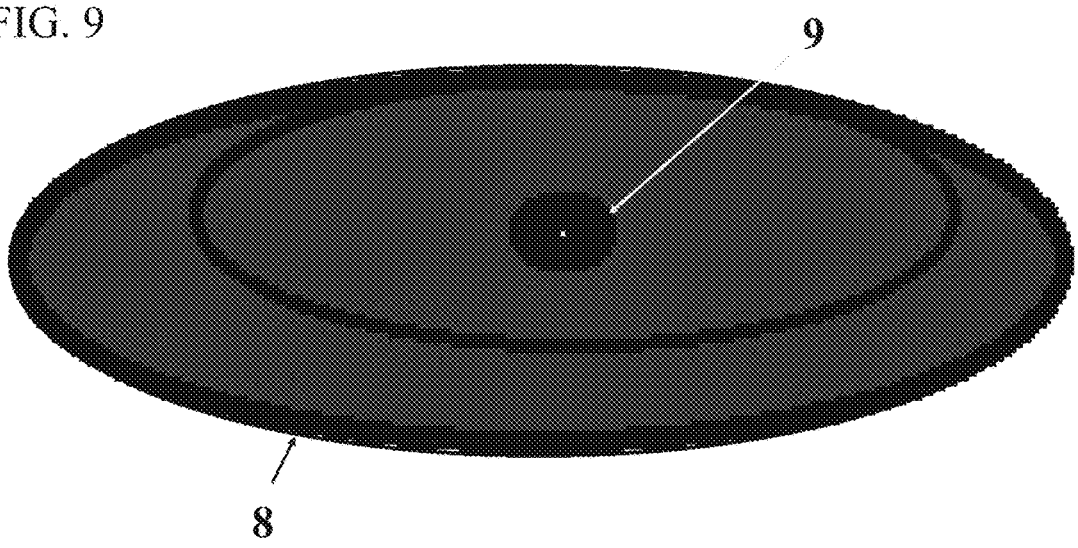
FIG. 9 is an enlarged perspective view of a sphincter valve vent, as seen in FIG. 8, useable in a baffle in a system according to the present invention.

Alternatively, or additionally, the apparatus and system may include a sphincter vent 8 in the baffle 5, as seen in FIGS. 8 and 9. Such a vent 8 through the wall of the baffle 5 defines a ring sphincter orifice 9 (FIG. 9). The orifice 9 is closed in the vent's static state, but opens passively under air pressure. Thus, increased air pressure within the baffle interior volume pushes outward against the baffle wall, which bends outward the vent 8 an "blows" or urges open the orifice 9. Any subsequent, even resulting, decrease in interior pressure allows the elastic wall of the baffle to rebound to its static state to close (fully or partially) the orifice 9. When functioning as a singular vent, the passive action allows an equal and opposite negative pressure pulse to occur. This momentary vacuum aids in isolating surface area reverberating deconstructive harmonics, as sound does not travel in a vacuum.

The two passive expanding vents 6 and 8 may be utilized separately or in concert with each other in combination upon a single apparatus. This allows the complete apparatus to be tuned to specific requirements. Both types of vents can be utilized to pass speaker wiring through the apparatus for ease of installation.

It is seen that the present system and apparatus allow only constructive harmonics to enter the ambient space (e.g., the room of a home or workplace, or the like) of the intended listener. Sound energy transmitted from the back side/face of the speaker 13 initially is confined and attenuated within the resiliently expandable/contractible baffle 5. This exposes every mass capable of reverberating sound energy to only constructive harmonics, allowing every solid item in the ambient space to become, effectively, a passive satellite speaker. The result achieved is lower volume levels producing greater perceived amplification levels.

This system and apparatus can be used anywhere a speaker is utilized, including, but not limited to, loudspeakers, amplifier/speaker assemblies, automotive sound systems, audio weaponry, headphones, over the ear hearing aids and devices utilized to assess hearing. Significantly, the system does not require the listener to face the speaker face in order to hear the full range of constructive harmonics owing to the phenomena outlined in the immediately previous paragraph, and described previously in this disclosure.

The system and apparatus benefit the hearing impaired as well as those of unimpaired hearing. By isolating and dissipating deconstructive sound wave energy at the source, amplified sound waves are reproduced accurately and without distortion. This makes all sound waves easier to discern. Significantly, the apparatus does not require any speaker enclosure in addition to that described herein. Therefore, speakers may be incorporated into (for example) fanciful creations of art, or into oddly shaped or confined spaces, which is not possible with an unsightly, large, and/or inflexible LHRE.

Figure 16:
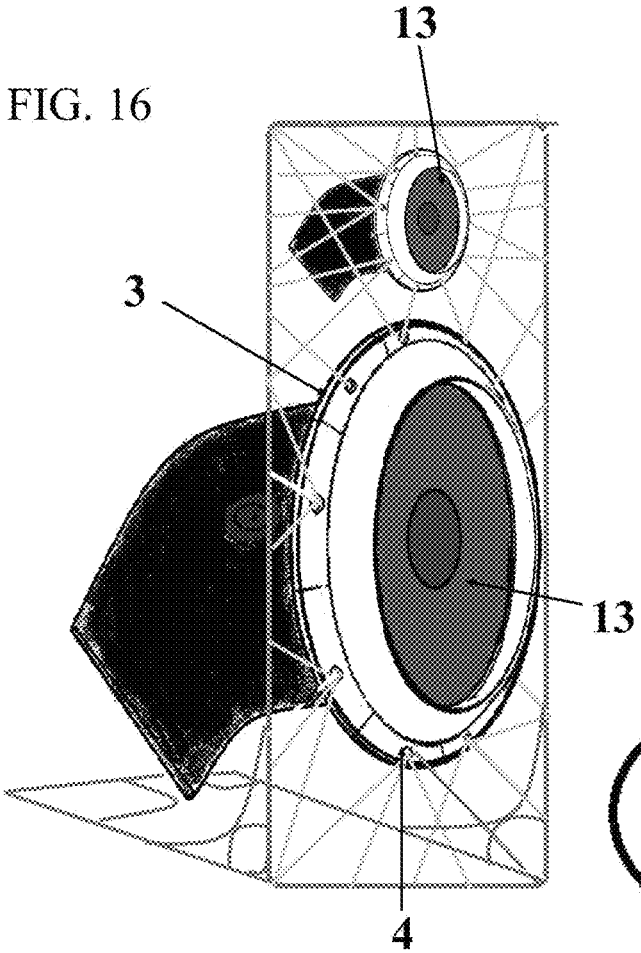
FIG. 16 is a perspective front view of two systems according to the present invention, shown freely suspended in a floor-standing framework.
Figure 17:
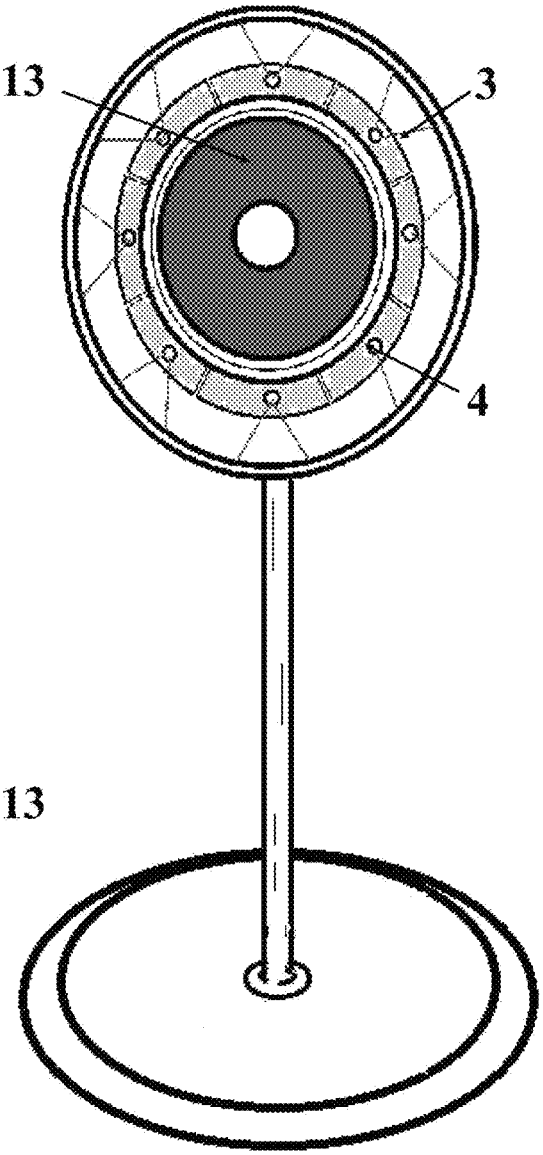
FIG. 17 is a front perspective view of a system according to the present invention, shown freely suspended in a framework atop a floor-standing pedestal.
Figure 18:
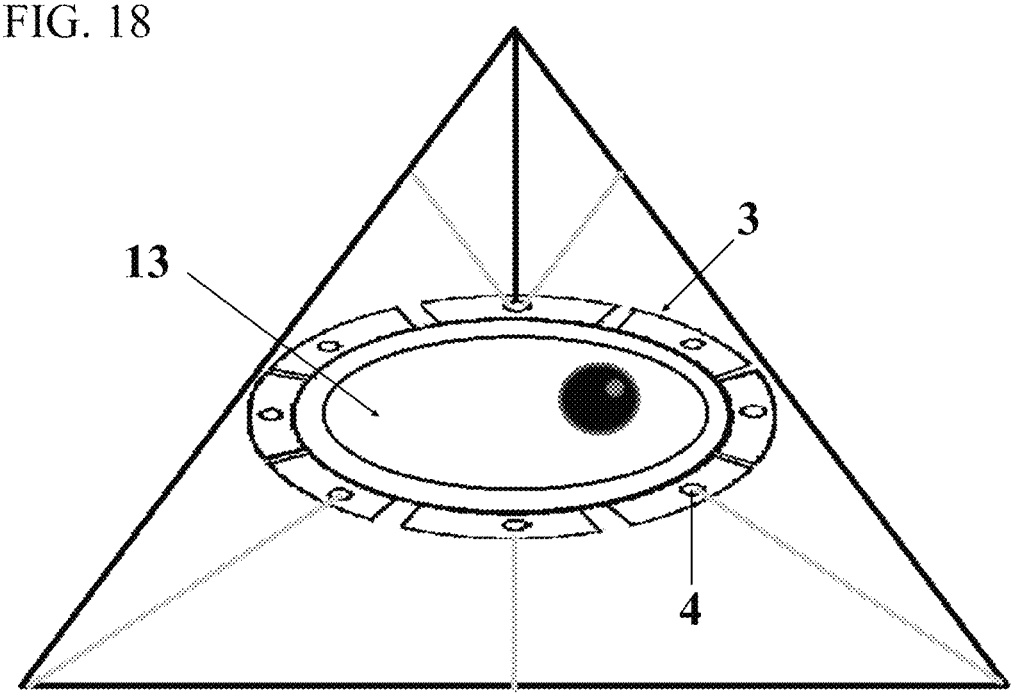
FIGS. 18-19 are views of alternative modes of mounting a system according to the present invention.
Figure 19:
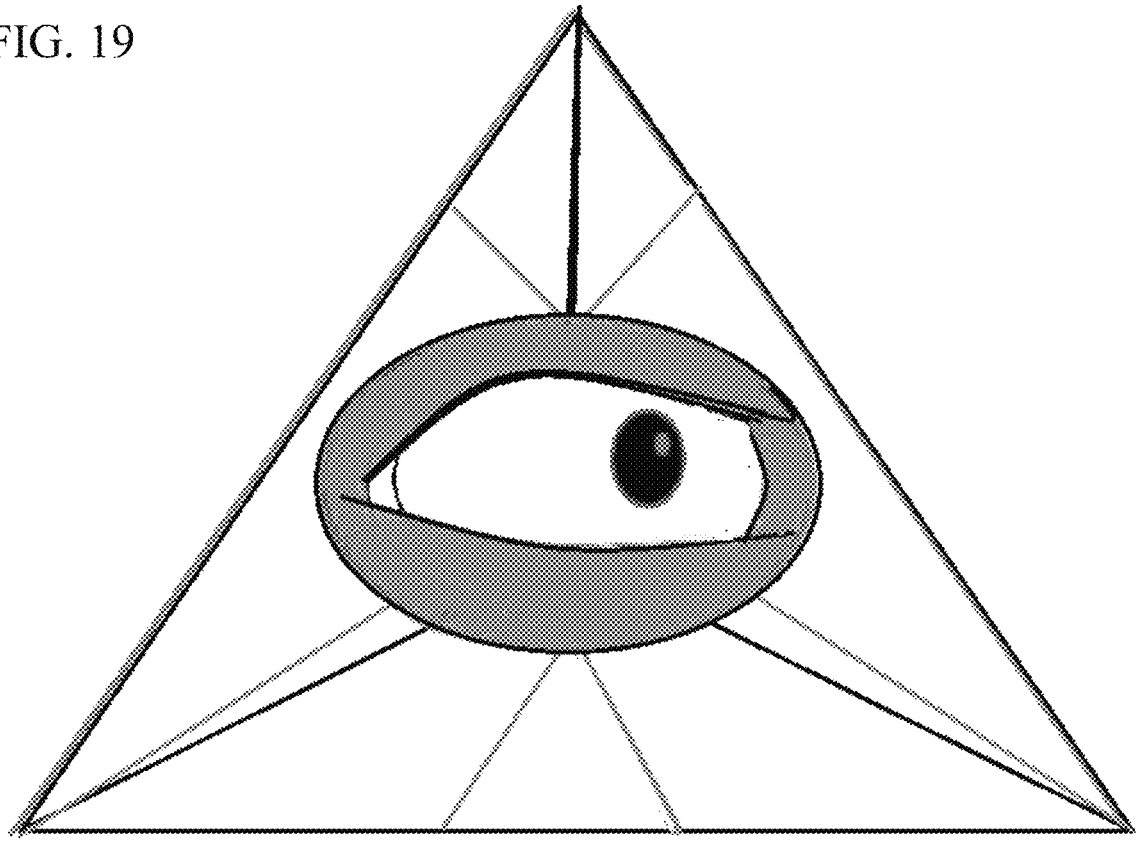

FIGS. 16, 17, 18, and 19 depict innovative speaker designs possible with the present apparatus. In FIG. 16, a pair of speakers 13, disposed within an encapsulation and isolation system according to the present invention, are suspended by an aesthetic array of flexible cords or bands within a floor-standing frame FIG. 17 shows a speaker 13 similarly suspended in a circular, pedestal mounted frame. FIGS. 18 and 19 are similar but abstract. According to the foregoing, the system thus may be used to suspend a speaker 13 in a frame or on a stand or boom, in a manner similar to the manner in which suspension microphones are suspended, by passing resilient strings, wire or fibers through the integrated mounting holes 4 to a frame, as depicted in FIGS. 16, 17, and 18.

Figure 20:
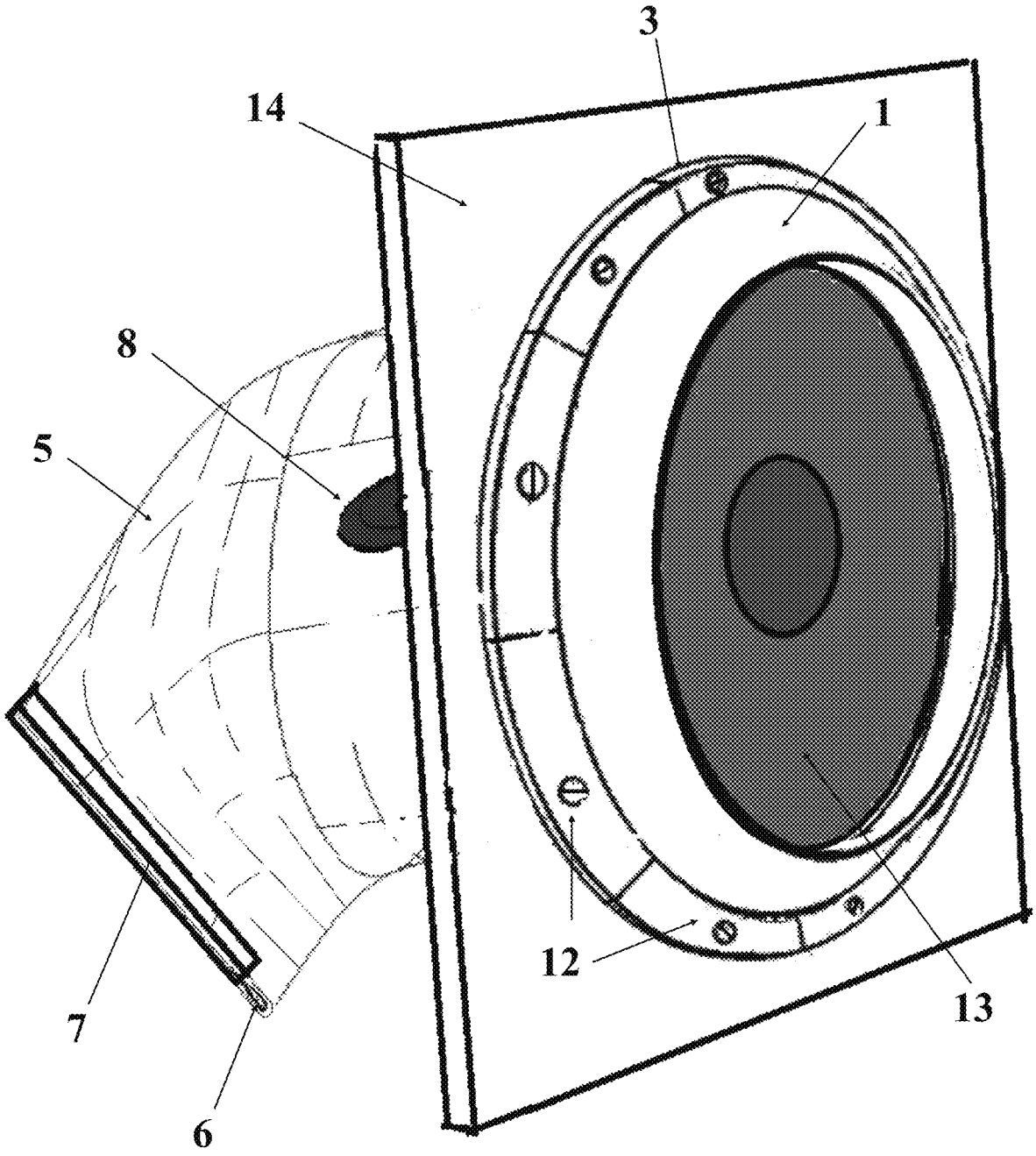
FIG. 20 is a front perspective view of a system according to the present invention, shown attached to a selected substrate.

The system also may be utilized to mount a speaker 13 on any surface or substrate via the attachment flange 3, by passing fasteners 12 through the integrated mounting holes 4 (FIG. 20). This allows speakers designed to produce low frequency harmonics to be mounted on or to any substrate, for example; an automobile's rear deck, or in the automobile's door, without further enclosure—a distinct advantage over LHREs—as suggested by FIG. 20.

Another advantage of the system and apparatus is realized in an automotive application; again, only constructive harmonics are allowed to act upon all the various rigid substrates of the car. The entire vehicle resonates with only constructive harmonics, so even the vehicle's exterior acts as a passive speaker emitting only constructive harmonics. This "total vehicle" effect has been noted by industry professionals to allow the listener to experience nearly the same clarity of harmonics outside the car as she does while in the interior. Industry professionals also note that lower volume levels are required for greater amplification perception without the preponderance of low frequency harmonics that occur when utilizing LHRE.

Although the invention has been described in detail with particular reference to these preferred embodiments, other embodiments may achieve the same results. In the previous description, specific details are set forth, such as specific materials, structures, chemicals, processes, etc., in order to provide a thorough understanding of the present invention. However, as one having ordinary skill in the art would recognize, the present invention can be practiced without resorting to the details specifically set forth. In other instances, well known principles of mechanics and physics have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover with the appended claims all such modifications and equivalents.

I claim:

1. A system for passive dissipation of deconstructive harmonics during audio amplification or reproduction from an audio speaker, the speaker having a front face and a rear, the system comprising:

an elastically resilient bendable encapsulation and isolation body within which the audio speaker is placeable;

a mounting flange upon the outer periphery of the isolation body; and a flexible baffle comprising a single sheet of resilient material connected to the mounting flange and extending rearwardly from the speaker, which baffle dissipates deconstructive sound waves emitted from the rear of the speaker.

2. The system according to claim 1 wherein the isolation body defines a circular or rectilinear ring.

3. The system according to claim 1 wherein the isolation body is an annulus, and the speaker is disposed within a central opening of the annulus.

4. The system according to claim 1 wherein the mounting flange comprises a unitary annular ring.

5. The system of claim 4 wherein the mounting flange comprises an elastically resilient, bendable, material.

6. The system according to claim 1 wherein the mounting flange comprises a plurality of separate, rigid, arcuate flange segments arrangeable to define a segmented annular ring;

wherein the flange segments are uniformly spaced to match the annular ring to a circumference of the outer periphery of the encapsulation and isolation body, so the annular ring can expand and contract as an integrated unit with the encapsulation and isolation body.

7. The system according to claim 1 wherein the baffle is injection molded from an elastically flexible polymer.

8. The system according to claim 1 wherein the flexible baffle defines a tube having a proximate end sealably secured directly to the mounting flange, and a distal end.

9. The system according to claim 1 wherein the baffle is comprised of a sheet of elastic, air-resistive material rolled to define a tubular topology, and with two edges of the sheet in mutual contact and sealed together.

10. The system according to claim 9 wherein the flexible baffle comprises a proximate end sealably secured to the mounting flange, and a distal end.

11. The system according to claim 1 wherein the baffle is comprised of an injection-molded elastic, air resistive material molded in a shape selected from the group consisting of a boot shape, a frustoconical tube, or a bowl.

12. The system according to claim 1 wherein the baffle is comprised of a sheet of elastic, air resistive material manipulated to define a shape selected from the group consisting of a boot shape, a frustoconical tube, or a bowl.

13. The system according to claim 1 further including a vent in the baffle.

14. The system according to claim 13 wherein the vent comprises an opening in the distal end of the baffle, which opening is enlargeable or reducible in size by a moving a clip disposed upon the distal end of the baffle.

15. The system according to claim 13 wherein the vent comprises a sphincter vent in a wall of the baffle.

16. A system for passive dissipation of deconstructive harmonics during audio amplification or reproduction from an audio speaker, the speaker having a front face and a rear, the system consisting essentially of:

an elastically resilient bendable encapsulation and isolation body within which the audio speaker is placeable;

a mounting flange upon the outer periphery of the isolation body; and a flexible baffle comprising a single sheet of resilient material connected to the mounting flange and extending rearwardly from the speaker, which baffle dissipates deconstructive sound waves emitted from the rear of the speaker;

wherein the system excludes the use of a large heavy rigid enclosure near the rear of the speaker.

17. A system for passive dissipation of deconstructive harmonics during audio amplification or reproduction from an audio speaker, the speaker having a front face and a rear, the system comprising:

an encapsulation and isolation body within which the audio speaker is placeable;

a mounting means upon the isolation body exterior;

a resiliently flexible baffle connected to the mounting means and extending rearwardly from the speaker; and a vent in the baffle, the vent comprising an opening in the distal end of the baffle, which opening is enlargeable or reducible in size by a moving a clip disposed upon the distal end of the baffle.

18. The system according to claim 17, wherein:

the encapsulation and isolation body is elastically resilient and bendable;

the mounting means comprises a mounting flange upon the outer periphery of the isolation body; and the flexible baffle defines a tube having a proximate end sealably secured directly to the mounting flange.

19. The system according to claim 18, wherein:

the mounting flange comprises a plurality of separate, rigid, arcuate flange segments arrangeable to define a segmented annular ring; and the flange segments are uniformly spaced to match the annular ring to a circumference of the outer periphery of the encapsulation and isolation body, so the annular ring can expand and contract as an integrated unit with the encapsulation and isolation body.

* * * * *